United States Patent [19]

Maier-Laxhuber et al.

[11] Patent Number: 4,752,310

[45] Date of Patent: Jun. 21, 1988

[54] ADIABATIC HEATING AND COOLING PROCESS AND PORTABLE DEVICES IN ACCORDANCE WITH THE ADSORPTION PRINCIPLE

[76] Inventors: Peter Maier-Laxhuber, Saumweberstrasse 14, 8000 Munchen 60; Fritz Kaubek, Heilmannstrasse 25, 8000 Munchen 71, both of Fed. Rep. of Germany

[21] Appl. No.: 748,573

[22] Filed: Jun. 25, 1985

[30] Foreign Application Priority Data

Jul. 10, 1984 [DE] Fed. Rep. of Germany ..... 3425491

[51] Int. Cl.[4] ..... F25D 5/02

[52] U.S. Cl. ..... 62/4; 165/104.12; 62/477; 62/480; 62/66; 62/294; 126/263

[58] Field of Search ..... 62/476, 477, 480, 294, 62/4, 66; 126/263; 165/104.12

[56] References Cited

U.S. PATENT DOCUMENTS 4,205,531 6/1980 Brunberg et al. ..... 62/477
4,531,384 7/1985 Paeye ..... 62/477

FOREIGN PATENT DOCUMENTS 513598 2/1955 Italy ..... 62/4

*Primary Examiner*—Albert W. Davis, Jr.
*Attorney, Agent, or Firm*—Hoffmann & Baron

[57] ABSTRACT

The invention describes portable cooling and heating devices and their process of operation in accordance with the adsorption principle utilizing the adsorption substance pair of zeolite-water. The devices operate without substance and heat exchange from the environment, in that the evaporation heat originates from the solidifying heat of a non-evaporating amount of water and that the released adsorption heat is stored in the form of tangible heat of the zeolite filler. The ice which had been generated during the adsorption process is suitable for human consumption.

10 Claims, 3 Drawing Sheets

ADIABATIC HEATING AND COOLING PROCESS AND PORTABLE DEVICES IN ACCORDANCE WITH THE ADSORPTION PRINCIPLE

BACKGROUND OF THE INVENTION

The invention relates to a process and portable devices for changing temperatures in accordance with the adsorption principle wherein operating agents are evaporated from a predetermined amount of operating agents being adsorbed in an adsorption agent by releasing the adsorption heat.

Processes and transportable devices for cooling and heat generation in accordance with the absorption principle are known. An easily evaporating operating agent is absorbed by a more difficult absorption agent. Useable cold is generated during the evaporation of the operating agent, while also useable absorption heat is released in the absorption agent during the absorption. Shut off devices within the steam chamber prevent an absorption outside of the operation. The cold or heat generation is initiated by opening the shut off devices. For reactivating the devices, the absorption agent is heated and the escaping operating agent is condensed. Devices in accordance with this process permit either the heating or cooling of goods, for example, foodstuffs or drinks.

All devices thereby depend on a heat exchange with the environment. For example, if an article should be heated with the released absorption heat, the evaporation heat for the operating agent must be simultaneously received from the environment. If, in the reversed situation, the goods should be cooled, then the absorption heat must be discharged to the environment. Very expensive heat exchangers are provided for this heat exchange which render the portable systems heavy, expensive and inert due to low heat transfer coefficients. Therefore, disposable devices which are suitable for a one time use become uneconomical. Adiabatic processes without heat exchange with the environment are not possible with the known pairs of absorption substances.

The requirements for the pairs of absorption substances are numerous. Only a few pair of substances have a sufficiently wide field of solution and the thermodynamic basic prerequisite for a sufficient temperature distance between the evaporation and the absorption. Furthermore, they should be easily regeneratable, non-corrosive, non-toxic and stable. Compatibility with the environment must be assured, in particular, with disposable devices. An accidental contact with foodstuff should not result in any damage. Portable devices should be lightweight in construction. Therefore, the container walls must be thinly constructed. Hence, high operating agent steam pressures are not suitable. The reaction kinetic must occur rather rapidly. Hitherto, no pair of substances could be mentioned which would meet these requirements.

SUMMARY OF THE INVENTION

It is therefore an object of the present invention to provide processes and portable cooling and heating devices with which a rapid and effective cooling and/or heating of goods is made possible without having a heat or substance exchange with the environment of the device.

This object of the invention is solved in that an operating agent is used in the process in accordance with the adsorption principle which receives its evaporation heat from the solidification heat of the amount of operating agent which does not evaporate, and that an adsorption agent is used which can store the released adsorption heat in form of specific heat in the adsorption agent itself.

This is made possible by using water as the operating agent and zeolite as the adsorption agent. The water and the zeolite are present in two containers within the evacuated cooling and heating device and are separated by a shut off device. Upon opening of the shutoff device, steam flows into the zeolite filler and is adsorbed while simultaneously releasing heat. Further water evaporates from the water filler by cooling and subsequent icing of the remaining water filler. The zeolite filler can adsorb water as long as its increasing temperature is in a thermodynamic balance with the already adsorbed amount of water under the steam pressure of the ice. Therefore, the adsorption heat is adiabatically storable in the form of specific heat of the zeolite filler, the absorbed amount of water and the container material. For example, 100 g zeolite Na-X have adsorbed 7,5 g water in the balanced stage at a temperature of 140° C. and a steam pressure of 600 hPA. About 42 g water having 25° C. cool down to 0° C. and may be completely frozen with the generated evaporation or sublimation cold. This evaporation process occurs completely adiabatic. Therefore, without a heat exchange with the environment one can simultaneously provide heat and cooling.

The combination of zeolite-water meets all requirements for an optimum pair of adsorption substances. The unusually wide spread field of charge permits also high temperature differences with relatively low amounts of zeolite. Zeolites are edible and can be economically synthesized. The adsorption process is nonsensitive to position and shocks and a volume change is disregarded. The zeolite types Na-A, Mg-A, Ca-A, Na-X, Na-Y and H-Y show no decomposition even after a frequent regeneration.

The type H-Y is pH-neutral even in watery solution. When making ice, contamination of the water filler has no influence on the edibility of the ice. Synthetic zeolites are commercially available in powder or granulate form. Powder-like zeolites may be processed into blanks by means of binder agents which are adapted to the cooling or heating devices. Specifically designed blanks may be used for reinforcing the container walls, for example, thus permitting a simplified container construction or the saving of container material. Expensive pressure tanks are not required when using water as the operating agent.

Zeolites heat partially from room temperature to above 160° C. during the adiabatic adsorption process. However, for many heating requirements, temperatures of about 80° C. are sufficient. Zeolites can adsorb more water with lower temperatures. If additional heat storage masses are heat conductively coupled to the zeolite filler, a part of this adsorption heat can be transferred to these heat storage masses. Since the temperatures in the zeolite filler are therefore lower, more steam can be adsorbed and more adsorption heat can be made available. Additional heat storage masses are advantageously liquids like, for example, coffee, tea, soups which can be taken in a hot stage from the device. Small gas-tight closed water capsules are suitable for disposable devices for making ice, for example, which are uniformly distributed in the zeolite filler and adsorb a part of the adsorption heat, thus reducing the required amount of zeolite.

Also, the evaporation enthalpy may be partially extracted from other substances, for example, drinks. In this manner, the container with the drink is heat conductively coupled to the water container.

The ice which is generated during the adsorption process is edible. Since zeolites are also edible, no danger exists for the user even with improper handling. The reaction speed of the pair of substances is so high that the water filler solidifies to ice in a few seconds in suitable containers and can be taken out of these containers. A refilling with fresh water and a reactivation of the zeolite filler is possible, but in light of the low material value, it would be impractical. Usually such devices for making ice are designed as disposable systems. Water fillers which are dimensioned too large only partially freeze or are not cooled to the freezing point. If further substances are admixed to the water filler, for example, lemonade substances, fruit juices, alcohols, ice cream mixtures, etc., the fillers may be served strongly cooled or frozen, after opening the cooling device.

The shut off devices are advantageously designed as steam valves for cooling and heating devices which are constructed for reactivating the zeolite filler. Smaller water valves are sufficient in disposable systems. These water valves must be so designed that they permit a discharge of the total water filler from the water container into the zeolite container.

The zeolite filler should be so arranged within the zeolite container that is does not come into contact with the incoming water. Particularly thick ice layers may be made in that the water, which flows slowly into the zeolite container, flows onto already frozen ice layers and thereby freezes.

In a particular embodiment of the invention the water container is shaped as a drinking container. After opening the one-way system, the ice may remain in the drinking container and may be poured over by the drinks to be cooled. In a further embodiment of the invention the drinking container assumes the function of the shut off device. For this purpose, the container is pushed against a face of the zeolite container with a specific mechanism in such a manner that the container opening is closed.

All cooling and heating devices must be evacuated during the manufacturing. For this purpose, the zeolite filler is heated by means of a heating source to a temperature between 250° C. and 700° C. The steam desorbed from the zeolite discharges from the zeolite container through a small closeable evacuation opening and thereby takes along the enclosed air. Therefore, no specific vacuum pumps are required. In an analog manner the water container is separately or simultaneously evacuated. During a simultaneous evacuation the container must be so arranged that the water filler in the water container is brought to a boiling point by the excess heating of the discharging steam or by the radiation heat from the hot zeolite filler, so that the steam which discharges through the shut off device, for example, removes non-condensable gases from the water container.

BRIEF DESCRIPTION OF THE DRAWINGS

A plurality of exemplified embodiments in accordance with the invention are illustrated in the drawing and are described in more detail in the following.

DETAILED DESCRIPTION

Figure 1:
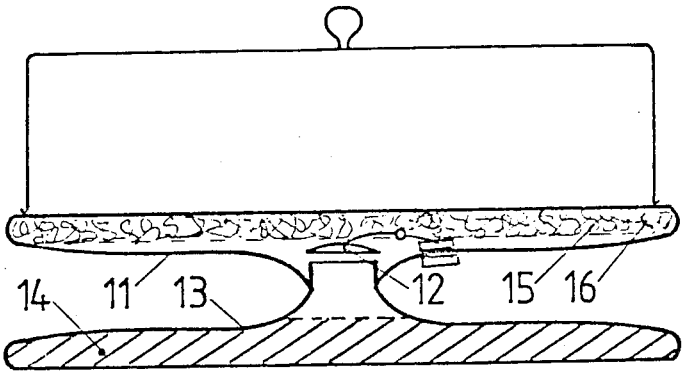
FIG. 1 depicts a combined cooling and heating plate.

FIG. 1 shows a combined cooling and heating plate in a sectional view. A water container 11 is connected to a zeolite container 13 containing a zeolite filler 14 by means of a magnetically actuable shut off device 12. An absorbable material 16 fixes the water filler 15 on the correct side of the container. The plate with the water container 11 is placed upwardly for the purpose of cooling and the magnetically acting shut off device 12 is opened. The water filler 15 partially evaporates and solidifies. The zeolite filler 14 adsorbs the steam and stores the released adsorption heat in form of tangible heat. The plate with the zeolite container is placed upwardly for the purpose of heating or keeping articles hot.

For reactivation purposes, the plate with the zeolite container side may be placed onto a hot stove plate, for example. Thereby, the shut off device 12 permits a flow of the steam desorbed by the zeolite filler 14 into the water container 11, even when the shut off device is closed. The condensate heat is emitted to the environment.

Figure 2:
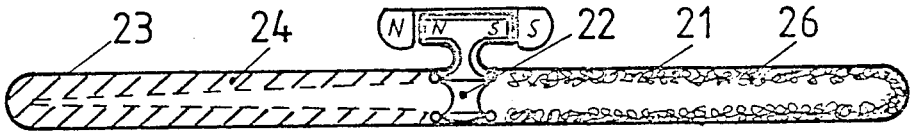
FIG. 2 depicts a combined cooling and heating rod.

FIG. 2 illustrates a cooling and heating rod which operates in accordance with the same principle as the cooling and heating plate of FIG. 1. For cooling, the water 21 is immersed into a liquid for heating the zeolite container 23 and the magnetic valve 22 is opened. For reactivating purposes the zeolite filler 24 in the zeolite container 23 is heated to about 250° C. and the escaping steam is condensed on the water container wall 21. The absorbable material 26 distributes the condensate uniformly.

Figure 3:
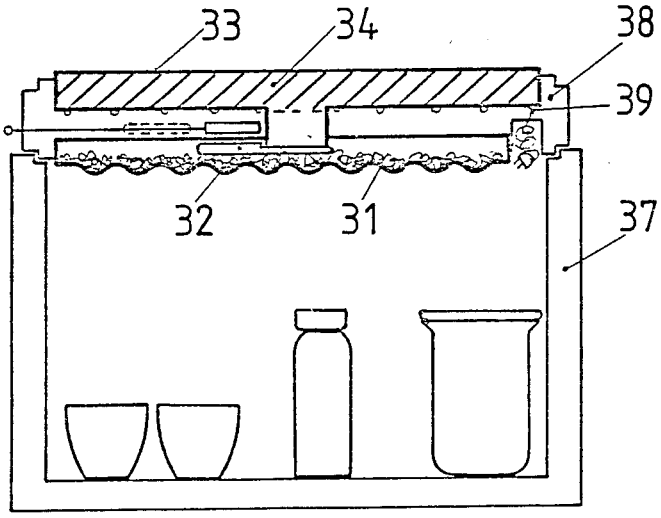
FIG. 3 depicts a combined cooling and heating pouch with integrated reactivating device.

FIG. 3 illustrates a further embodiment of the invention in the form of a combined cooling and heating pouch. The sectional Fig. illustrates an insulation box 37 and a cooling and heating device in accordance with the invention in lid 38. The lid 38 is designed as a reverse lid, so that the cooling water container 31 or the heating zeolite container 33 point into the inner chamber of the insulation box 37, depending on the intended purpose. The cooling or heating operation is also activated by actuating the shut off device 32 or is interrupted by the shut off device. A thermostatically controlled heating device 39 is mounted on the outer face of the zeolite container for reactivating the zeolite filler 34. To make sure that the reactivation of the zeolite filler 34 does not occur when the pouch is closed, for safety reasons, the current supply cable and the associated operating switch are so disposed that a regeneration cannot occur when the pouch is closed.

Figure 4A:
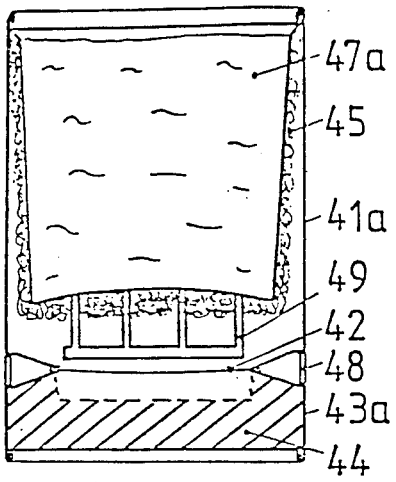
FIG. 4*a* depicts a cooling device for drinks.

FIG. 4*a* illustrates a cooling device for drinks before being used. The water container 41*a* is separated from the zeolite container 43*a* by a steam-tight membrane 42. A hollow space for the drink 47*a* to be cooled is disposed in a recess of water container 41*a*. A support ring 48 on the connecting face of the containers is removed to initiate the cooling effect. Thus, the outer air pressure pushes the container walls together. Thereby, the steam-tight membrane 42 is cut by a cutting knife 49. Now, the path for the steam is free. The cooling effect occurs immediately.

Figure 4B:
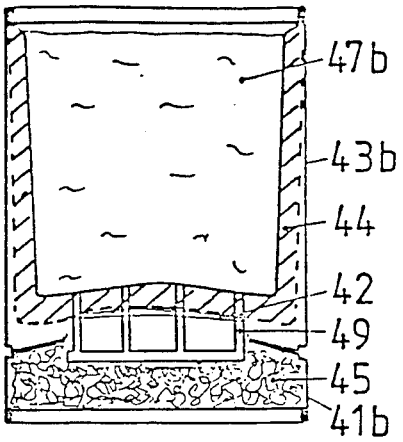
FIG. 4*b* depicts a heating device for drinks.

FIG. 4*b* illustrates a heating device for drinks after activation in accordance with the same principle. The drink 47*b* to be heated is disposed in the recess of the zeolite container 43*b*. The steam-tight membrane 42 is already separated by the cutting knife and has been taken along the steam flow into the zeolite container 43*b*. The water filler 45 is solidified to ice and the zeolite filler 44 is hot.

Figure 5:
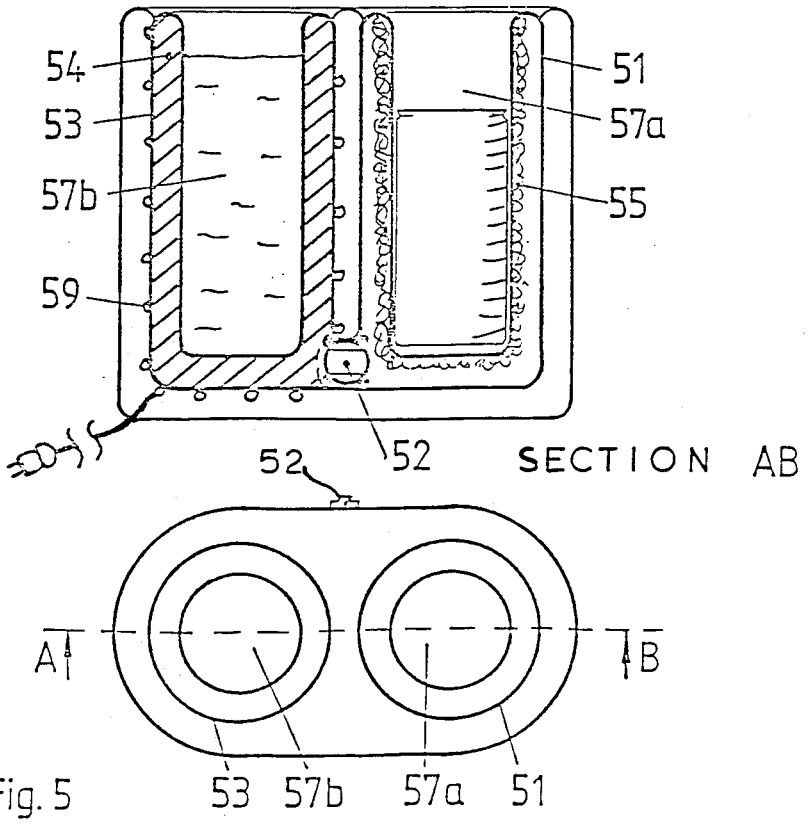
FIG. 5 depicts a combined cooling and heating device for containers and liquids.

FIG. 5 illustrates a sectional and plan view of a further inventive cooling and heating device. The zeolite container 53 and the water container 51 have the shape of a double jacket with cup-like recesses 54*a* and 57*b* for the direct reception of liquids or containers, like cans, for example. The zeolite container 53 is encompassed by a heatable sleeve 59 for reactivating the zeolite filler 54. A leakage free shut off device 52 prevents the adsorption of steam from the water filler 55 in the zeolite filler 54 in the closed stage, but permits an unhindered backflow of the steam desorbed from the zeolite filler 54 into the water container 51. The cooling and heating device may be used either for cooling only or for heating, or for a simultaneous cooling and heating. In all modes of operation is it irrelevant whether the given other cup-like recess 57*a* or 57*b* is filled or is empty.

Figure 6:
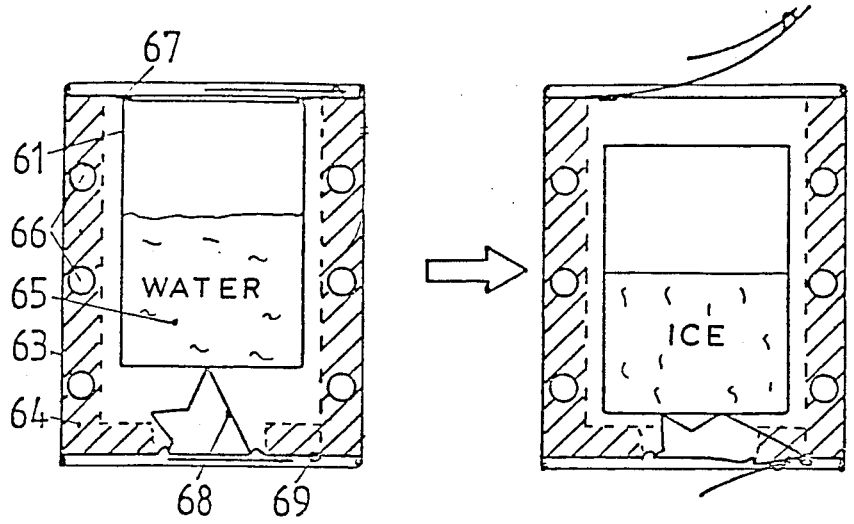
FIG. 6 depicts a cooling and heating device for making ice with a shut off device for steam.

FIG. 6 is a portable device before and after the adsorption reaction for making edible ice or for cooling liquids. The water filler 65 is disposed in the cup-like water container 61. The water container 61 and the zeolite filler 64 are disposed within the zeolite container 63. The zeolite filler 64 consists of a solid zeolite blank which reinforces the zeolite container wall. Additional heat storage elements 66 are imbedded into the blank. They consist of water filled metal capsules, for example. The cup-like water container 61 is pushed with its opening against a sealing ring 67 in the lid of the zeolite container by means of a trigger device 68. The outer air pressure supplies the required pressure, whereby the bottom and the lid of the zeolite container 63 are slightly arched inwardly. Further substances may be admixed to the water filler 65 in water container 61, for example, milk products or basic lemonade substances. In order to initiate the adsorption reaction, the bottom of the zeolite container is mechanically deformed by means of a tongue until the trigger device 68 yields to the pressure of the steam in the water container 61 and separates the container from the sealing ring 67. Thus, the path for the steam to the zeolite filler 64 is free. Within a few seconds the water filler 65 is frozen into ice and the zeolite filler 64 is hot. The lid of the zeolite container 63 is removed and the ice filler together with the water container 61 are removed.

Figure 7:
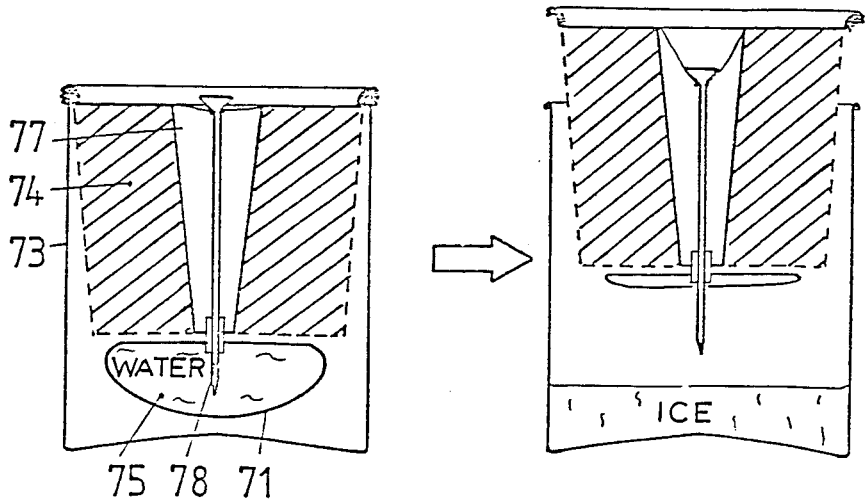
FIG. 7 depicts a cooling and heating device for making ice with a shut off device for water.

FIG. 7 illustrates a further embodiment of a device for making ice before and after the adsorption reaction. The zeolite container 73 contains the zeolite filler 74 as well as the water container 71 with the water filler 75. A further container 77 extends into the zeolite filler 74 which contains a heat storage mass, for example, water, coffee, etc. A plug device 78 extends through the bottom of container 77 and into the flexible water container 71. An opening is pierced into the lower sheath of the water container 71 with this plug device 78 for making ice. Thereupon, the water filler 75 discharges into the zeolite free part of the zeolite container 73 and freezes into ice in a few seconds. The zeolite filler 74 feeds a part of the released adsorption heat to the heat storage mass in container 77. After the ice is formed, the lower part of the zeolite container 73 together with the ice filler is separated from the remaining part of the device.

Thus, the several of afforenoted objects and advantages are most effectively attained. Although several somewhat preferred embodiments have been disclosed and described in detail herein, it should be understood that this invention is in no sense limited and its scope is to be determined by that of the appended claims.

What is claimed is:

1. A method for forming ice by a substantially adiabatic process, the method comprising the steps of:

causing the communication between first and second selectively communicating containers, the first container being evacuated and having water contained therein, the second container being evacuated and having zeolite contained therein, the water being substantially free of all non-condensible gases, the zeolite being substantially free of all water content, wherein a quantity of water evaporates to form water vapor and releases adsorption heat thereby causing the water remaining in liquid form to solidify into ice, the water vapor traveling from the first container to the second container and being adsorbed by the zeolite, the quantity of water in the first container being such that an amount of water remains to solidify and form ice after a portion thereof has evaporated, the quantity of zeolite being such to absorb the water vapor evaporated from the water.

2. A substantially adiabatic process for operating cooling and heating devices utilizing the adsorption principle, comprising the steps of:

evaporating under vacuum a liquid operating agent from a predetermined amount of operating agent, the liquid operating agent being contained in an evacuated first container and the evaporation thereof releasing heat from the unevaporated liquid operating agent remaining in the first container;

causing the first container to communicate with a selectively communicating second chamber, the second container being evacuated and containing a solid adsorbent agent, whereby the evaporated operating agent rapidly expands from the first container into the second container;

adsorbing under vacuum the evaporated operating agent by the solid adsorbent agent contained in the second container; and solidifying the unevaporated liquid operating agent remaining in the first container whereby the heat of solidification given off by the solidifying liquid operating agent is used as heat of evaporation for evaporating the liquid operating agent while requiring no heat exchange with the environment in order to evaporate the liquid operating agent.

3. The invention in accordance with claim 2 wherein the cooling and heating device includes a water container filled with water, an evacuated zeolite container filled with dry zeolite, and a shut off device connecting both containers which in the open position permits steam to flow from the water container into the zeolite container and the solidifying heat of the water which does not evaporate is sufficient to heat the zeolite adiabatically to the maximum ignition temperature in the adsorption reaction.

4. The invention in accordance with claim 3 wherein the zeolite filler consists of synthetic zeolites of the type A, X and Y, in particular, in the forms of Na-A, Mg-A, Ca-A, Na-X or H-Y.

5. The invention in accordance with claim 3 wherein the zeolite filler consists of zeolite types with react in a watery solution pH-neutral, as for example, H-Y and H-X.

6. The invention in accordance with claim 3 wherein an opening is provided in the water container with the assistance of the shut off device through which water discharges into the zeolite container and solidifies therein by means of partial evaporation.

7. A cooling and heating device operable in accordance with the adsorption principle wherein operating agents are evaporated from a predetermined amount of operating agents and adsorbed in an adsorption agent by releasing the adsorption heat and where the amount of operating agent which is not evaporated is solidified and the released solidifying heat is used as the evaporation heat for the amount of operating agent being evaporated and that the adsorption heat is storable in the absorption agent itself in the form of tangible heat, while requiring no heat exchange with the environment comprising; a water container filled with water, an evacuated zeolite container filled with dry zeolite filler, and a shut off device connecting both containers which in the open position permits steam to flow from the water container into the zeolite container and where the solidifying heat of the water which does not evaporate is sufficient to heat the zeolite adiabatically up to the maximum ignition temperature in the adsorption reaction.

8. The invention in accordance with claim 7 wherein the zeolite filler consists of synthetic zeolites of the type A, X and Y, and in the forms of Na-A, Mg-A, Ca-A, Na-X or H-Y.

9. The invention in accordance with claim 7 wherein zeolite filler consists of zeolite types which react in a watery solution pH-neutral.

10. The invention in accordance with claim 7 wherein an opening is provided in the water container with the assistance of the shut off device through which the water discharges into the zeolite container and solidifies therein by means of partial evaporation.

* * * * *